United States Patent [19]

Bidegain

[11] 4,308,023

[45] Dec. 29, 1981

[54] MACHINE FOR MANUFACTURING A TUBULAR ELEMENT

[75] Inventor: Georgy Bidegain, Serres Castet, France

[73] Assignee: EMBADAC, Morlaas, France

[21] Appl. No.: 92,419

[22] Filed: Nov. 6, 1979

[30] Foreign Application Priority Data

Nov. 10, 1978 [FR] France ..... 78 31855

[51] Int. Cl.[3] ..... B31B 1/44

[52] U.S. Cl. ..... 493/295; 493/176; 493/303; 493/457

[58] Field of Search ..... 93/94 PS, 94 R, 94 FC, 93/77 CL, 77 R, 81 R, 12 R, 12 C, 36.05, 39.1 P, 44; 493/295, 303, 304, 269, 167, 174, 175, 176, 457

[56] References Cited

U.S. PATENT DOCUMENTS

| | | | |
|---|---|---|---|
| 755,754 | 3/1904 | Day et al. | 93/12 R |
| 2,075,679 | 3/1937 | Weber | 493/295 X |
| 3,018,702 | 1/1962 | Bauder | 93/12 R X |
| 3,476,022 | 11/1969 | Scully | 93/12 R |
| 3,589,097 | 6/1971 | Gianese | 93/12 C X |

FOREIGN PATENT DOCUMENTS

| | | |
|---|---|---|
| 633406 | 1/1928 | France . |
| 194467 | 4/1938 | Switzerland . |

*Primary Examiner*—James F. Coan
*Attorney, Agent, or Firm*—Young & Thompson

[57] ABSTRACT

A process and machine for manufacturing a tubular element, for example for use in forming boxes, in which a strip of material is wound around a mandrel having a cross-section corresponding to that of the tubular element to be formed. The strip of material is arranged to extend in a plane and the mandrel is applied against the strip in a direction perpendicular to said plane to cause lateral parts of the strip to lift up on either side of the mandrel and to define two flaps projecting above the mandrel. A force is then exerted on each of the flaps in a direction parallel to said plane to fold the flaps down onto the mandrel and to bring their free edges into abutment.

2 Claims, 10 Drawing Figures

MACHINE FOR MANUFACTURING A TUBULAR ELEMENT

BACKGROUND TO THE INVENTION

The present invention relates to a process and to a machine for manufacturing a tubular element, for example for use in forming boxes, such as cardboard bell boxes which are used for packaging in the perfume industry. It is possible for the tubular element to have any cross-section, that is to say round, oval, square or polygonal, with sharp or rounded corners, and so on, to have any desired height, that is to say tall or short, and to have a single or multiple thickness of cardboard, for example a double thickness, over all or part of its height.

If a double thickness of cardboard is provided over the greater part of the height of the tubular element, leaving a margin of single thickness, the latter makes it possible to complete the formation of the box with a double base.

Hitherto, the automatic manufacture of boxes on a machine has not made it possible to produce boxes of which the height is large, relative to the dimensions of the base, as in the case of bell boxes. It is for this reason that these bell boxes are generally constructed by hand.

SUMMARY OF THE INVENTION

The present invention relates to a process for manufacturing a tubular element of any cross-section and of any height, that is to say large or small, which permits automatic manufacture on a machine.

According to the invention there is provided a process for manufacturing a tubular element from a strip of material, in which process the strip of material is wound around a movable mandrel, the mandrel having a cross-section which corresponds to that of the tubular element to be formed and having a perimeter corresponding to the length of the strip, the process comprising the steps of presenting the strip in a plane, placing the mandrel with its axis parallel to said plane opposite a median part of the strip, applying the mandrel to said median part in a direction perpendicular to said plane so as to cause the two lateral parts of the strip to lift up on either side of the mandrel and to form two flaps projecting above the mandrel, and exerting a force on each of the flaps in a direction parallel to said plane and perpendicular to the axis of the mandrel to fold the flaps down onto the mandrel and bring their edges into abutment.

This process, which can be performed automatically on a machine, provides faultless winding of the strip, with precise matching of the edges, without the risk of producing bulging parts.

Generally, where the edges are to be brought into abutment, it is usual to start at one edge and to continue winding until the other edge joins up therewith. In the process according to the invention, the winding is started not at an edge but at the median part of the strip, and this permits the two folding forces which are exerted in a direction parallel to the initial plane of the strip to ensure the edgewise join. The winding is thus completed by developing continuous application forces, which avoid the risks of producing bulging parts.

Breaking the forces down into two successive directions perpendicular to one another permits convenient automation on a machine, as will moreover become apparent in greater detail below.

The process according to the invention makes it possible to manufacture a tubular element of multiple thickness, in particular of double thickness, over all or part of its height. In the case of a double thickness, a first strip of material, which will form the inside thickness, is wound around a mandrel, the mandrel having a cross-section which corresponds to that of the tubular element to be formed and having a perimeter which corresponds to the length of the said first strip, the strip being wound around the mandrel such that the free edges thereof abut, the edgewise join being held by adhesion, a second strip of material, which will form the outside thickness and which is adhesive, is then wound around the said first strip of material and caused to adhere thereto, the free edges of the second strip being brought together into abutment.

Preferably, the winding of the first strip and the winding of the second strip is carried out successively on two similar machines, the first machine having a bare mandrel before the first strip is wound thereon, whilst the second machine has a mandrel onto which the first strip, wound on the first machine, is first positioned before the second strip is wound thereon.

It will be noted that the process, according to the invention, for manufacturing a tubular element of double thickness is different from the known manual method for forming bell boxes of double thickness. In the known manual method the outer envelope is formed first, after which the inner lining is positioned inside the envelope. It is precisely this difference which enables the process according to the invention to be carried out on a machine.

Preferably, to carry out in this way the process, according to the invention, for manufacturing a tubular element of double thickness, the operations for producing a tubular element of single thickness are applied twice in succession.

More particularly, for winding the first strip around the mandrel and for winding the second strip around the first strip, which is held edge to edge and is itself engaged on a mandrel, each strip is presented in a plane, the corresponding mandrel is placed with its axis parallel to the said plane and opposite a median part of the said strip, the corresponding mandrel is applied to the said median part by exerting a force in a direction perpendicular to the said plane so as to cause the two lateral parts of the strip to lift up on either side of the mandrel to form flaps projecting above the mandrel, and a force is exerted on each of the flaps of the said raised lateral parts, in a direction parallel to the said plane and perpendicular to the axis of the mandrel, in order to fold the said flaps down onto the mandrel and bring their edges into abutment.

The present invention also relates to a machine for manufacturing a tubular element in accordance with the above-mentioned process.

According to the invention there is provided a machine for manufacturing a tubular element from a strip of material by winding the strip around a movable mandrel, the machine comprising a plinth having a working surface in which a guide cavity is defined, the mandrel being mounted so as to be movable in a first direction perpendicular to said working surface between a rest position, spaced apart from said working surface, and a working position, engaged in the said cavity and projecting slightly above said working surface, two folding members which are mounted one on each side of the said cavity so as to be movable in a direction parallel to the said surface and perpendicular to the axis of the cavity, between a rest position, spaced apart from the cavity, and a working position in which they are arranged to cover the mandrel when the mandrel is in its working position, and control means for displacing the said mandrel and the said folding members.

Preferably, each folding member has a thinned front end which forms an upper lip and is followed by an inclined ramp, the height of the ramp corresponding to that of the slightly projecting part of the mandrel above the working surface, when the mandrel is in its working position.

BRIEF DESCRIPTION OF THE DRAWINGS

Embodiments of the present invention will hereinafter be described, by way of example, with reference to the accompanying drawings, in which.

DESCRIPTION OF THE PREFERRED EMBODIMENTS

FIGS. 1 to 9 illustrate a machine, according to the invention, for manufacturing a cardboard tubular element intended for forming the side wall of a bell box used, in particular, for packaging in the perfume industry and other applications.

This machine makes it possible to manufacture a tubular element having any cross-section, that is to say round, oval, square, polygonal or the like, with sharp or rounded corners and of any desired height, that is to say large or small.

Figure 9:
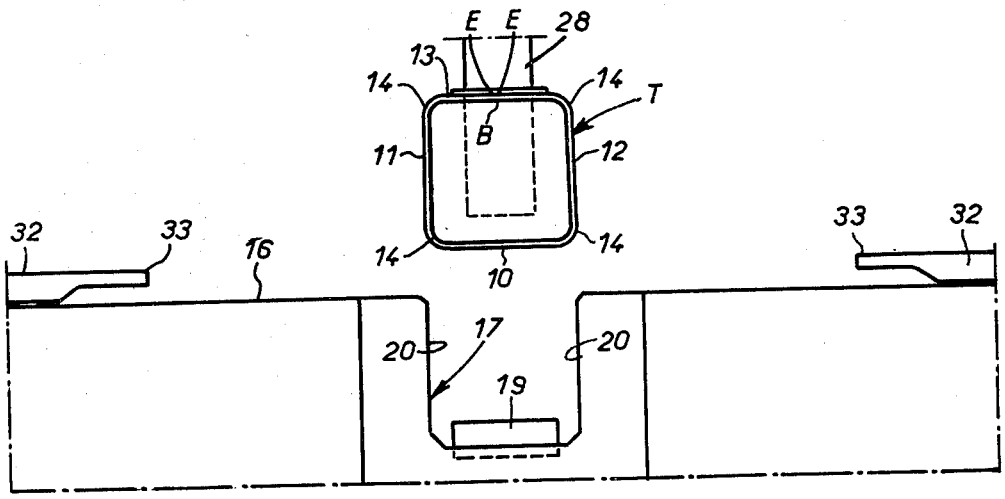

This tubular element, designated by T (FIG. 9), is produced from a cardboard strip portion P (FIG. 2) having two ends E. The tubular element T is produced by winding this strip portion P so that the two ends E abut at B (FIG. 9).

Figure 1:
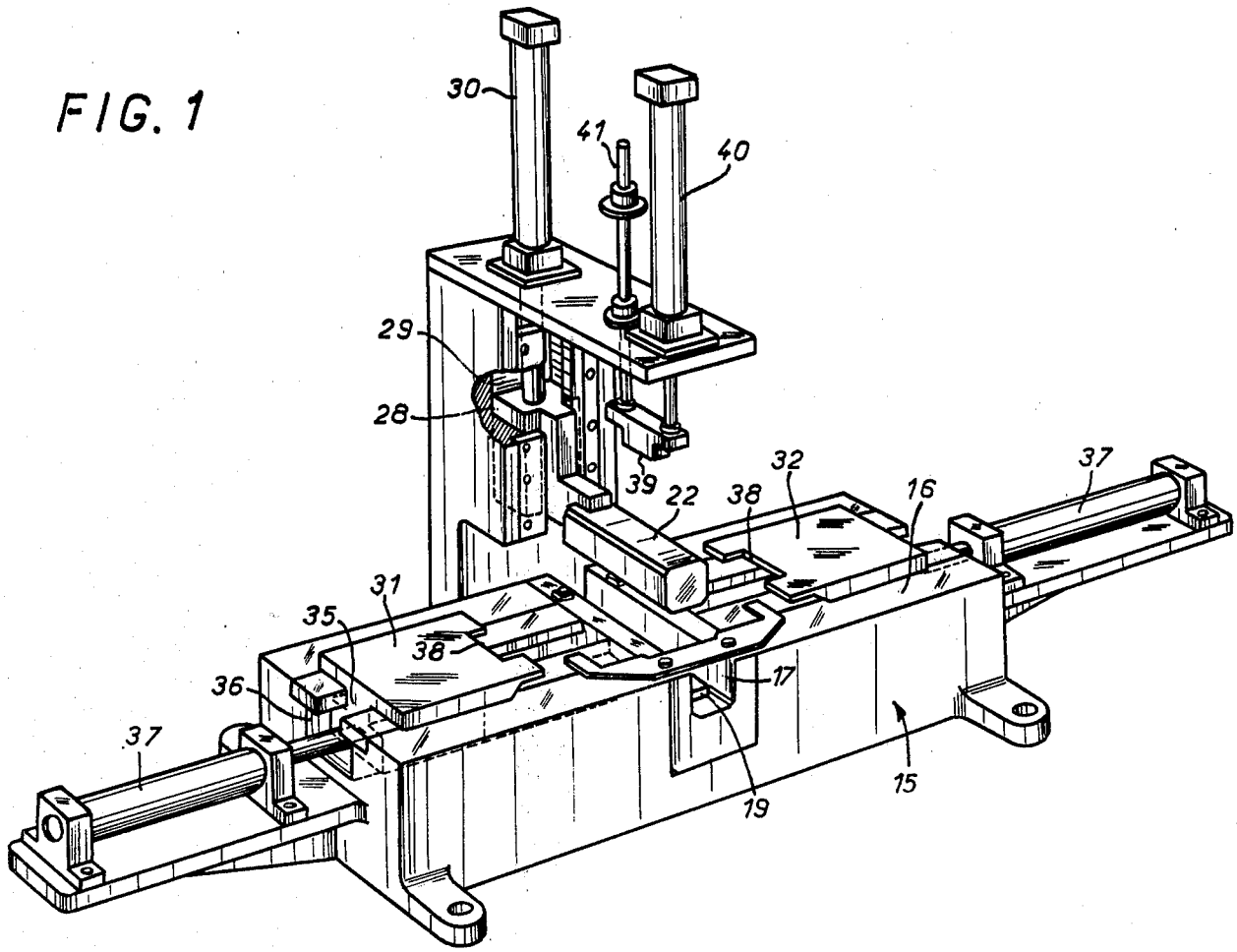
FIG. 1 shows a perspective view of a machine for manufacturing a tubular element according to the invention.
Figure 2:
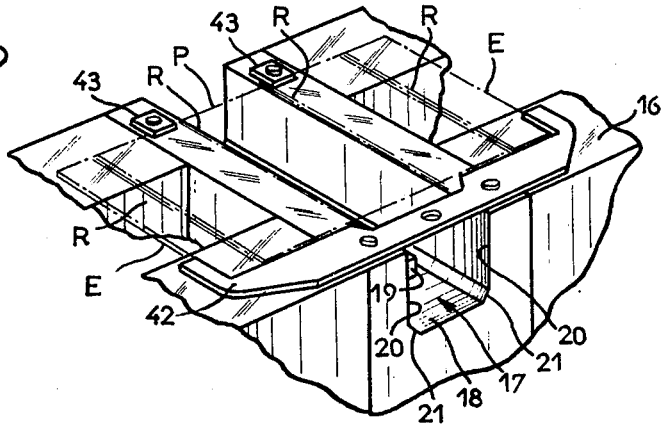
FIG. 2 shows the guide cavity of the machine of FIG. 1 and also shows means for positioning a strip portion before winding.

The ends E can be straight, as shown in FIG. 2, or they can be inclined, curved or serrated, provided that they come exactly edge to edge after winding.

In the example shown, the cross-section of the tubular element T (FIG. 9) is square, with a first side 10, which is opposite the join B, a second side 11 and a third side 12 both perpendicular to the side 10, and a fourth side 13, which is parallel to and opposite the side 10 and includes the edgewise join B along its central axis. This tubular element T of square cross-section has its rounded corners 14 (FIG. 9). In this case, the cardboard strip portion P advantageously has several series of preformed grooves along the four regions R (FIG. 2) which correspond to the rounded corners 14.

The machine comprises (FIGS. 1 to 9) a plinth 15 having a working surface 16 (FIG. 1) which, in the example shown, is horizontal.

The working surface 16 (FIGS. 1 and 2) has a guide cavity 17, of generally parallelepipedal shape, with a horizontal base 18, receiving a base plate 19 of adjustable height, vertical walls 20, and two inclined walls 21 joining the base 18 to the vertical walls 20.

The machine comprises a mandrel 22 which is advtageously heated and which is mounted so as to be movable perpendicular to the surface 16, that is to say in a vertical direction, between a rest position (FIG. 3) spaced above the surface 16, and a working position (FIG. 4) engaged in the cavity 17 in which it abuts against the base plate 19 and projects slightly by a distance D above the surface 16.

The mandrel 22 is interchangeable, as is the cavity 17, so that they can be adapted to the required cross-section of the tubular elements to be formed. The mandrel 22 and the cavity 17 are chosen, in this case, to have a cross-section which corresponds to the tubular element T.

The cross-section of the mandrel 22 therefore corresponds to the interior profile of the tubular element T and is square with rounded corners (FIG. 3), with a first side 23, which corresponds to the first side 10 of the tubular element T, a second side 24 and a third side 25, which respectively correspond to the sides 11 and 12 of the element T, and a fourth side 26, which corresponds to the fourth side of this element T, and rounded corners 27 which correspond to the rounded corners 14 of the element T.

Figure 4:
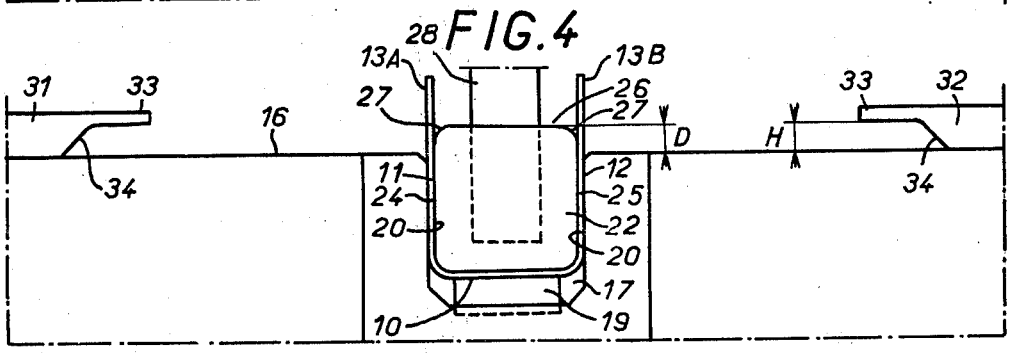

The width of the cavity 17 between the vertical walls 20 corresponds to the width of the mandrel 22 between the sides 24 and 25 plus twice the thickness of the cardboard of the strip portion P (FIG. 4).

The depth of the cavity 17, which can be adjusted by means of the base plate 19, is chosen such that when the mandrel 22 is engaged in the cavity, abutting against the base plate 19 (FIG. 4), the projection height D of the side 26 of the mandrel 22 above the surface 16 is slightly greater than the height taken up by a rounded corner 27 (FIG. 4).

The mandrel 22 is carried by a slide block 28 (FIG. 1) which is mounted so as to move in a slide 29 on the plinth 15. The movement of the slide block 28 is controlled by a vertical pneumatick jack 30 in order to bring the mandrel 22 from its rest position in FIG. 3 to its working position in FIG. 4, and vice versa.

The machine also comprises two folding members 31 and 32 which are mounted so as to move on either side of the cavity 17 in a direction parallel to the surface 16, that is horizontally perpendicular to the axis of the cavity 17. These folding members 31 and 32 are mounted so as to move between a rest position (FIG. 3), spaced apart from the cavity 17, and a closed working position (FIG. 6) in which they abut and cover the mandrel 22 when the latter is in its working position in the cavity 17. Each folding member 31, 32 has a front end 33 of reduced thickness which forms an upper lip and which is followed by a ramp 34, inclined for example, at 45°. The height H of the ramp 34 is chosen to be equal to D (FIG. 4) plus the thickness of the cardboard of the strip portion P.

Each folding member 31, 32 is integral with a respective slide block 35 which is engaged so as to move in a respective slide 36 on the plinth 16. The movement of the folding members 31 and 32 is controlled in both directions by horizontal pneumatic jacks 37.

The machine also comprises means for applying an adhesive bridge, for example a piece of adhesive tape, to the edgewise join B of the tubular element T after winding, in order to keep the element T in its tubular shape.

For this purpose, the upper lip 33 of each folding member 31, 32 possesses a notch 38. The notches 38 in the members 31 and 32 are located opposite one another so that when these members 31 and 32 are brought closer together until they abut, the notches constitute a central opening (FIG. 6) allowing access to the edgewise join B.

Any suitable means can be provided for applying the adhesive bridge to the edgewise join B inside the notches 38.

Figure 8:
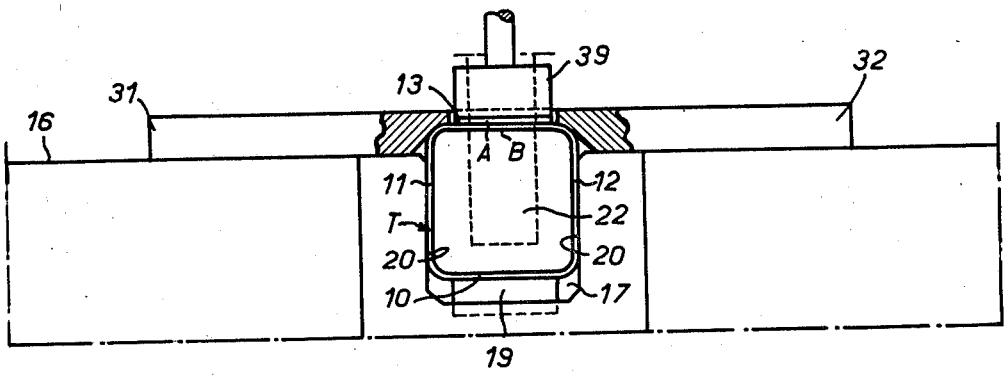

In the example shown, a pressing tool 39, which is advantageously heated, is mounted so as to slide in a vertical direction above the opening presented by the notches 38. The pressing tool 39 is moved in both directions by a vertical pneumatic jack 40 and the guiding of the tool is completed by means of a rod 41. The pressing tool 39 is mounted so as to move, under the action of the jack 40, between a rest position, spaced apart above the mandrel 22, and a working position in which it is applied to the mandrel 22 across the opening formed by the notches 38 (FIG. 8).

To form the tubular element T, the strip portion P (FIG. 2) is taken and laid flat on the working surface 16. The strip portion P is placed in the correct position by virtue of positioning means which, in the example shown in FIG. 2, comprise a positioning plate 42 and two studs 43, all of which are interchangeable and the position of which can be adjusted in advance.

Figure 3:
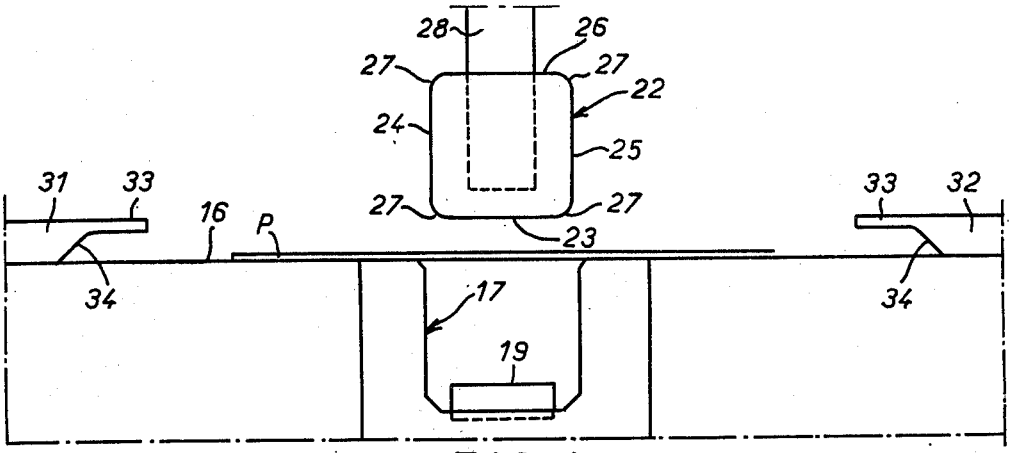
FIGS. 3 to 9 schematically illustrate various stages in the operation of the machine.

When the strip portion P is thus placed and positioned on the surface 16, its median part extends above the cavity 17 opposite the mandrel 22 (FIG. 3).

The jack 30 is actuated to lower the mandrel 22. The mandrel 22 forces the median part of the strip portion P, corresponding to the first side 10, into the cavity 17 until the first side 10 lies on the base plate 19. During the lowering of the mandrel 22 into the cavity 17, a rubbing action is exerted on the strip portion P, of which the pregrooved regions R thus closely match the lower rounded corners 27 of the mandrel 22, and of which the lateral parts corresponding to the sides 11 and 12 are lifted up on either side of the mandrel 22 and are guided between the mandrel 22 and the vertical walls 20 of the cavity 17. These raised lateral parts have flaps 13A and 13B, above the mandrel 22 (FIG. 4), which correspond to the two halves of the fourth side 13. The position is then the one shown in FIG. 4.

Figure 5:
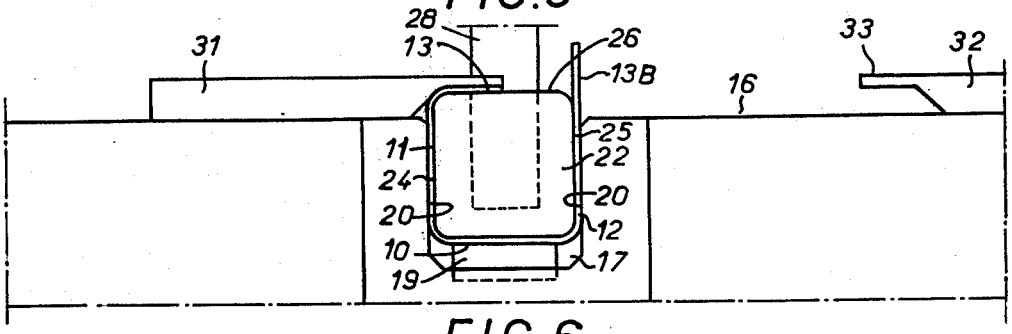

One of the folding members, namely the member 31, is then actuated by being moved from the position in FIG. 4 to that in FIG. 5, and this, because of the values chosen for the heights D and H, exerts a force on the flap 13A, corresponding to the first half of the fourth side 13, which causes a faultless application of a grooved region R of the strip P to the left-hand upper rounded corner 27 and also a faultless application of this half 13A of the fourth side 13 to the upper side 26 of the mandrel 22. The second folding member 32 is in turn actuated and causes, in the same manner, the folding of the second half 13B of the fourth side 13, which brings the ends E of the strip portion P exactly edge to edge at B.

Figure 6:
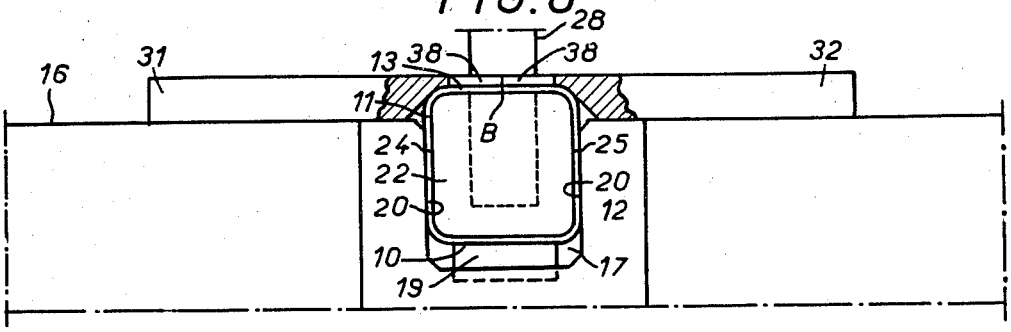
Figure 7:
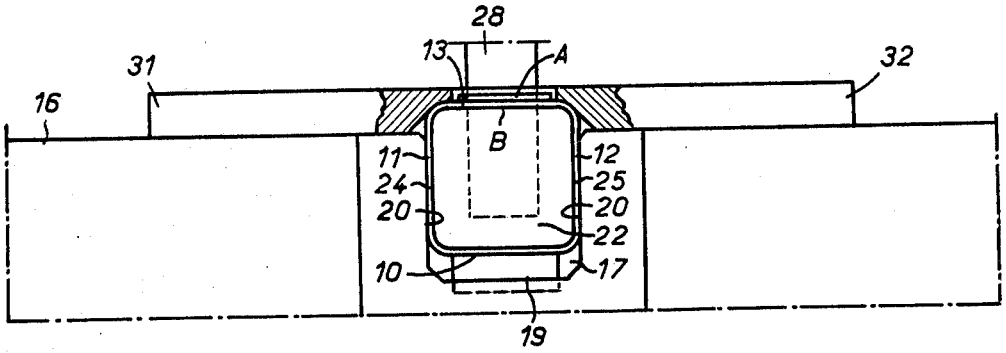

The position shown in FIG. 6 has thus been reached. The notches 38 form an opening opposite the edgewise join B.

An adhesive bridge A (FIG. 7), for example a piece of adhesive tape, is applied to the edgewise join B, whilst the tubular element T is confined by the folding members 31 and 32, and the jack 40 is actuated, which brings the pressing tool 39 (FIG. 8) onto the adhesive bridge A and applies the latter firmly to the fourth side 13 of the tubular element T; this has the effect of keeping this element T in its tubular shape with the edgewise join B.

The pressing tool 39 is then released, the folding members 31 and 32 are retracted and the mandrel 22 carrying the tubular element T is then raised above the cavity 17. The tubular element T which has thus been manufactured can then be withdrawn from the mandrel 22.

Figure 10:
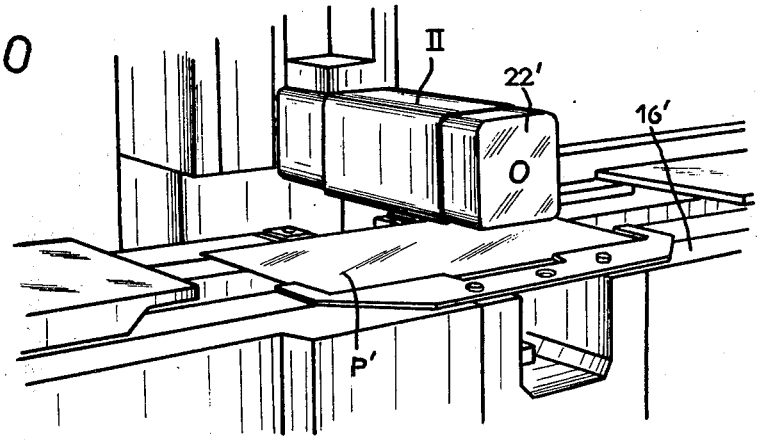
FIG. 10 is a partial perspective view of a machine of the invention, illustrating the formation of a tubular element of double thickness.

To manufacture a tubular element of double thickness, a tubular element is first formed in the manner described above, this element will constitute the inside thickness of the element of double thickness. An inside element TI is thus obtained (FIG. 10), which is withdrawn from the mandrel 22 of the machine which has just been described with reference to FIGS. 1 to 9, and which is placed on a mandrel 22' of another machine, analogous to the previous machine and located in the vicinity thereof (FIG. 10). The winding operation is then repeated by placing a strip portion P' which will form the outside thickness, on the working surface 16' of this second machine.

The strip portion P' has adhesive on one of its faces, and the strip portion P' is positioned on the working surface 16' so that the adhesive face faces upwardly. The operations described with reference to FIGS. 1 to 9, for the first machine, are repeated on the second machine of FIG. 10, and thus the strip portion P' is wound around the element TI to form the element of double thickness. The strip P' adheres to the strip P.

It should be noted that the machine of FIG. 10 does not need the pressing tool 39 or the notches 38 as the strip portion P' adheres to the inner tubular element TI.

If required, the strip P' may have a greater height than that of the strip P, so that the tubular element of double thickness possess a margin. When forming a bell box this margin can be used to provide a double base.

If required, the edgewise join of the inside element may be staggered with respect to that of the outside element, for example, by placing the edgewise join of the inner element TI on the lower side of the mandrel 22'.

I claim:

1. A machine for manufacturing a tubular element from a strip of material by winding the strip around a movable mandrel, the machine comprising a plinth having a working surface in which a guide cavity is defined, the mandrel being mounted so as to be movable in a first direction perpendicular to said working surface between a rest position, spaced apart from said working surface, and a working position, engaged in the said cavity and projecting slightly above said working surface, two folding members which are mounted one on each side of the said cavity so as to be movable in a direction parallel to the said surface and perpendicular to the axis of the cavity between a rest position, spaced apart from the cavity, and a working position in which they are arranged to cover the mandrel when the mandrel is in its working position, and control means for displacing the said mandrel and the said folding member, said control means bringing one of the folding members to its advanced position prior to the other of said folding members whereby the free edge of the folded over portion of the strip corresponding to said one folding member is brought to an arrested position before the free edge of the opposed, other folded over portion reaches its ultimate position thereby to form a smooth butt joint, each folding member having a thinned front end which forms an upper lip and is followed by an inclined ramp, the height of the ramp corresponding to that of the projecting part of the mandrel above said working surface when the mandrel is in the working position, the lip of each folding member having a notch which makes it possible to apply an adhesive bridge to the tubular element when the latter is confined by the said folding members.

2. A machine according to claim 1, further comprising means for pressing the adhesive bridge onto the tubular element across the opening formed by the said notches.

* * * * *